US007467714B2

(12) United States Patent
Slat et al.

(10) Patent No.: US 7,467,714 B2
(45) Date of Patent: Dec. 23, 2008

(54) CONTAINER STACK AND SEPARATING ELEMENT THEREFOR

(75) Inventors: William A. Slat, Brooklyn, MI (US); Richard C. Darr, Medina, OH (US); James R. Steinke, Brooklyn, MI (US); Michael E. Greyerbiehl, Westland, MI (US); Brett A. Sigurdson, Detroit, MI (US)

(73) Assignee: Plastipak Packaging, Inc., Plymouth, MI (US)

( * ) Notice: Subject to any disclaimer, the term of this patent is extended or adjusted under 35 U.S.C. 154(b) by 564 days.

(21) Appl. No.: 11/153,050

(22) Filed: Jun. 15, 2005

(65) Prior Publication Data

US 2006/0283755 A1 Dec. 21, 2006

(51) Int. Cl.
*B65D 21/032* (2006.01)
*B65D 81/133* (2006.01)
*B65D 81/127* (2006.01)

(52) U.S. Cl. ..... 206/509; 206/499; 206/589; 206/593; 206/821

(58) Field of Classification Search ..... 206/509, 206/499, 508, 821, 593, 585, 589, 386, 435, 206/430

See application file for complete search history.

(56) References Cited

U.S. PATENT DOCUMENTS

| | | | | | |
|---|---|---|---|---|---|
| 3,485,355 | A * | 12/1969 | Stewart | 206/509 |
| 3,730,340 | A * | 5/1973 | Neubert | 206/392 |
| 4,222,484 | A * | 9/1980 | Howe | 206/3 |
| 4,416,373 | A * | 11/1983 | deLarosiere | 206/432 |
| 4,685,565 | A * | 8/1987 | Sparling | 206/427 |
| 5,178,276 | A * | 1/1993 | Sheets | 206/427 |
| 5,927,499 | A * | 7/1999 | Vesborg | 206/509 |
| 6,367,645 | B1 * | 4/2002 | Trygg | 220/513 |
| 6,588,612 | B1 | 7/2003 | Dorn et al. | |
| 2002/0179481 | A1 * | 12/2002 | Noland | 206/509 |
| 2005/0269229 | A1 * | 12/2005 | Lowry | 206/386 |
| 2006/0000740 | A1 * | 1/2006 | Sigur | 206/509 |
| 2006/0260971 | A1 * | 11/2006 | Rivera et al. | 206/509 |
| 2007/0235363 | A1 * | 10/2007 | Whiteside et al. | 206/509 |

* cited by examiner

*Primary Examiner*—Anthony D Stashick
*Assistant Examiner*—Niki M. Eloshway
(74) *Attorney, Agent, or Firm*—Dykema Gossett PLLC

(57) ABSTRACT

The container stack includes a plurality of stacked containers and separator elements having open portions, with the outside containers in each level received in an opening. The outside openings engage the outer surface of the outside containers and press the outside containers inwardly to secure the containers in position.

19 Claims, 6 Drawing Sheets

CONTAINER STACK AND SEPARATING ELEMENT THEREFOR

BACKGROUND OF THE INVENTION

Containers, especially plastic containers, are widely used for a variety of products. These include plastic containers of widely varying sizes depending on the particular product and commercial needs. For example, it is not uncommon to have plastic containers having a capacity of one gallon, two gallons, or more.

It is particularly desirable to provide a firm and secure stack of a plurality of plastic containers, for example, to enable a firm and secure stack of containers on a pallet in multiple tiers without the necessity for intermediate stacking pallets or individual or multi-pack boxes. Secure stackability is particularly important for hazardous liquids. Moreover, bulky or large size plastic containers present a particularly difficult problem for stackability in view of their often flexible walls.

Some containers have stacking and nesting features; however, these containers have not been effectively commercialized especially in the larger sizes since each container may be quite heavy and it is difficult to effectively palletize without significant packaging materials to stabilize the units. Moreover, the added material for individual and/or multi-pack containers requires bulk breakdown time and considerable labor to move from warehouse and stockroom to point of sale locations. An additional problem for distribution and transportation of large containers is the cost of shipping and handling and the amount of damage incurred during shipment and handling. Also, with the growth of club stores and consumer direct warehouses where large package items are displayed and sold to customers, pallet quantities with easy product access and direct merchandising displays are required since shelves are often replaced with open floor space and large racking systems designed for pallets.

Accordingly, it is a principal objective of the present invention to provide a firm and secure container stack.

It is a further objective of the present invention to provide a container stack for effective palletizing wherein filled containers can be nested in layers or tiers.

It is a still further objective of the present invention to provide a container stack as aforesaid wherein filled containers can be firmly supported on a pallet and can be shipped and handled without damage.

It is a still further objective of the present invention to provide easily used materials for said container stack and which allow for point of sale signage and reduced material packaging.

Further objects and advantages of the present invention will appear hereinbelow.

SUMMARY OF THE INVENTION

In accordance with the present invention the foregoing objects and advantages are readily obtained.

In accordance with the present invention a plurality of stacked containers is provided which comprises: a plurality of containers, preferably plastic containers, each having an outer surface and a base portion, preferably with a depression therein, an upper finish portion opposed to said base portion, and a side wall extending therebetween; said finish portion preferably including an upwardly extending neck portion with an opening therein which is closable with a closure, wherein the finish portion and preferably the upwardly extending neck portion is nestable with the base portion and preferably with a depression in the base portion of an additional container and the base portion is nestable with the finish portion of an additional container as above; wherein a stack of said containers is provided by having a plurality of first containers in a first tier and a plurality of second containers nested with said first containers in a second tier, with each tier having outside containers and inside containers; and a separator element having outside open portions on opposed sides thereof, with the outside containers in the first tier each received in an outside open portion, wherein the outside open portions engage the outer surface of the outside containers to secure the containers in position. In a preferred embodiment the separator element has a plurality of openings therein, with outside openings and inside openings and with said openings corresponding to the spacing of said containers, with the containers in the first tier each received in an opening, wherein the outside openings engage the outer surface of the outside containers to secure the containers in position.

Preferably, the upwardly extending neck portions of the containers in the first tier are each received in an opening, wherein the outside openings engage the neck portions of the outside containers and press the outside containers inwardly and to secure the containers in position.

The present invention also provides one or more separator elements for placement on a plurality of containers arranged together with outside containers and inside containers and with each container having an outer surface, which comprises: a separator element having outside open portions on opposed sides thereof to receive the containers, wherein the outside containers are each received in an outside open portion and wherein the outside open portions engage the outer surface of the outside containers to secure the containers in position. In a preferred embodiment the separator element has a plurality of openings therein to receive the containers, said openings comprising outside openings and inside openings, with the outer surface of each outside container received in an opening; and wherein the outside and inside openings are spaced from each other with a spacing corresponding to the spacing of said containers, and wherein the outside openings engage the outer surface of the outside containers to secure the containers in position. Preferably said openings receive the neck portion of said containers and the outside openings engage the neck portion of the outside containers and press the outside containers inwardly to secure the containers in position.

Further features of the present invention will appear hereinbelow.

BRIEF DESCRIPTION OF THE DRAWINGS

The present invention will be more readily understandable from a consideration of the following illustrative drawings, wherein.

DETAILED DESCRIPTION OF PREFERRED EMBODIMENTS

It is highly desirable to provide effective and secure stacking of nestable, filled containers and permit effective palletizing of such containers. The present invention provides packaging materials for effective stacking and permits one to obtain a secure stack so that the filled, nested containers can be self-supported on the pallet without causing damage during transportation.

Figure 1:
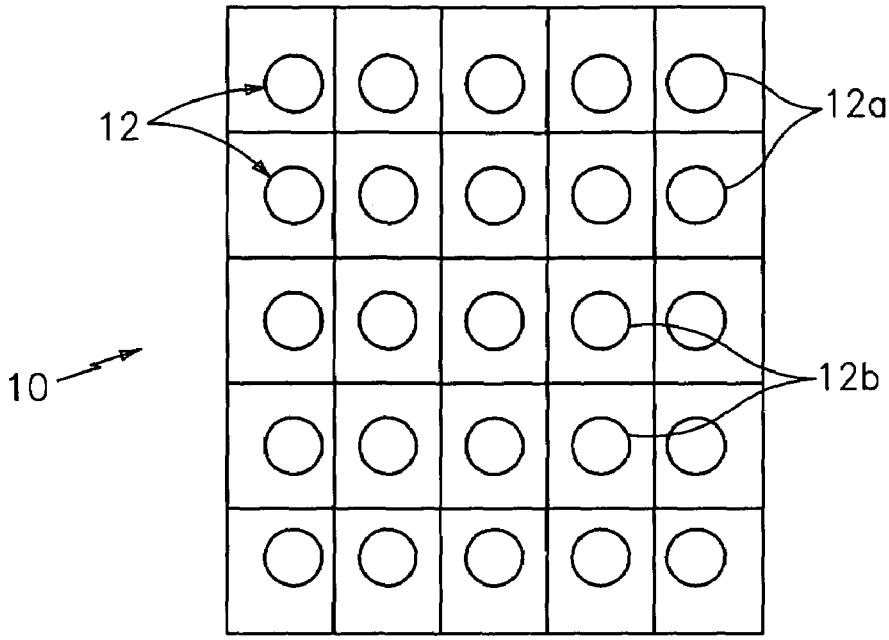
FIG. 1 is a top view of a separator element having a plurality of openings therein without containers received in the openings.
Figure 2:
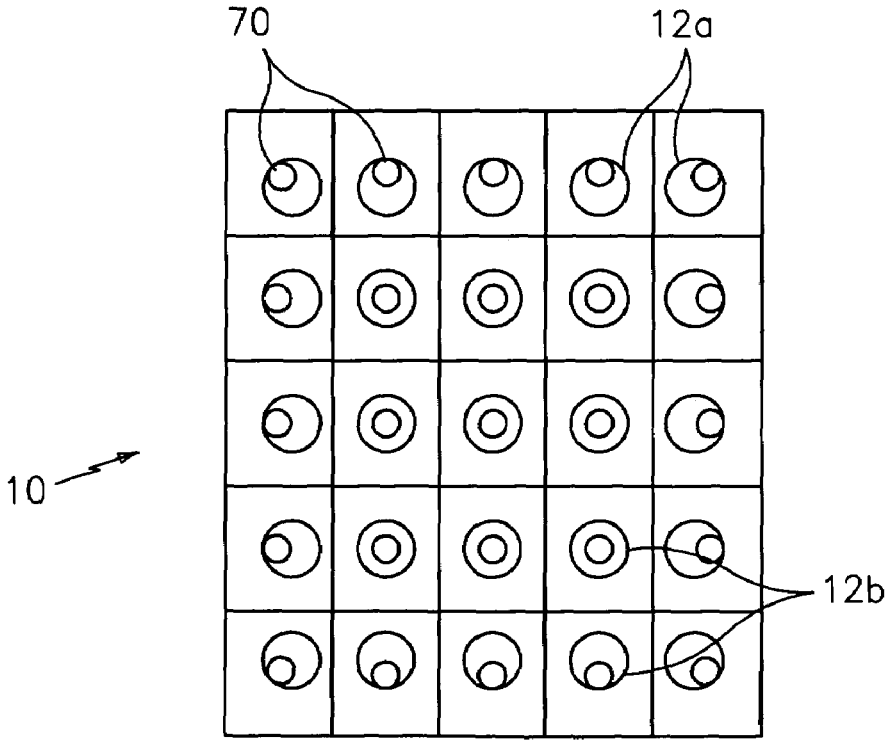
FIG. 2 is a top view of the separator element of FIG. 1 with containers each received in an opening.
Figure 3:
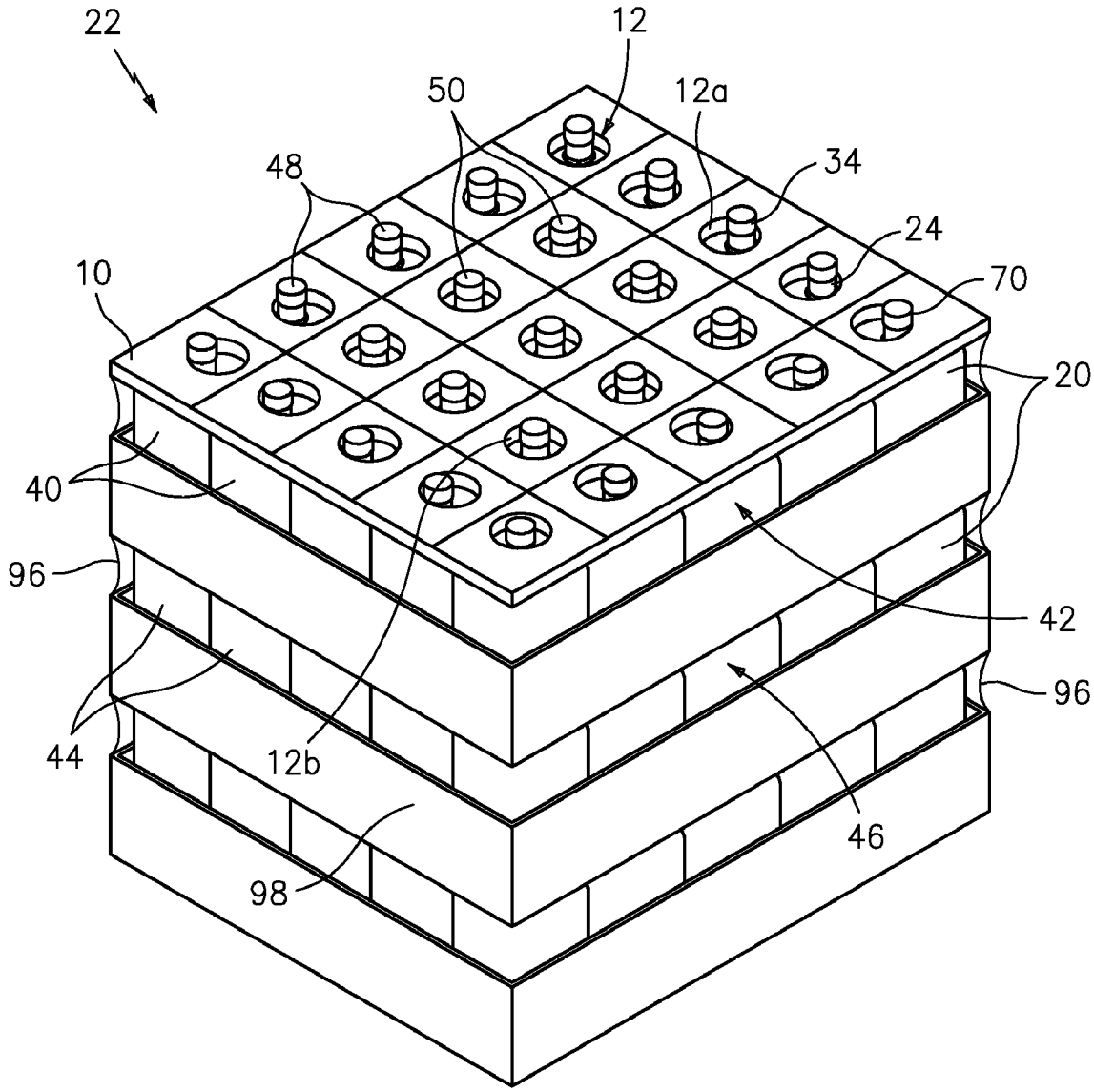
FIG. 3 is a perspective view of a stack of containers showing an upper level of containers received in the openings of a separator element.
Figure 4:
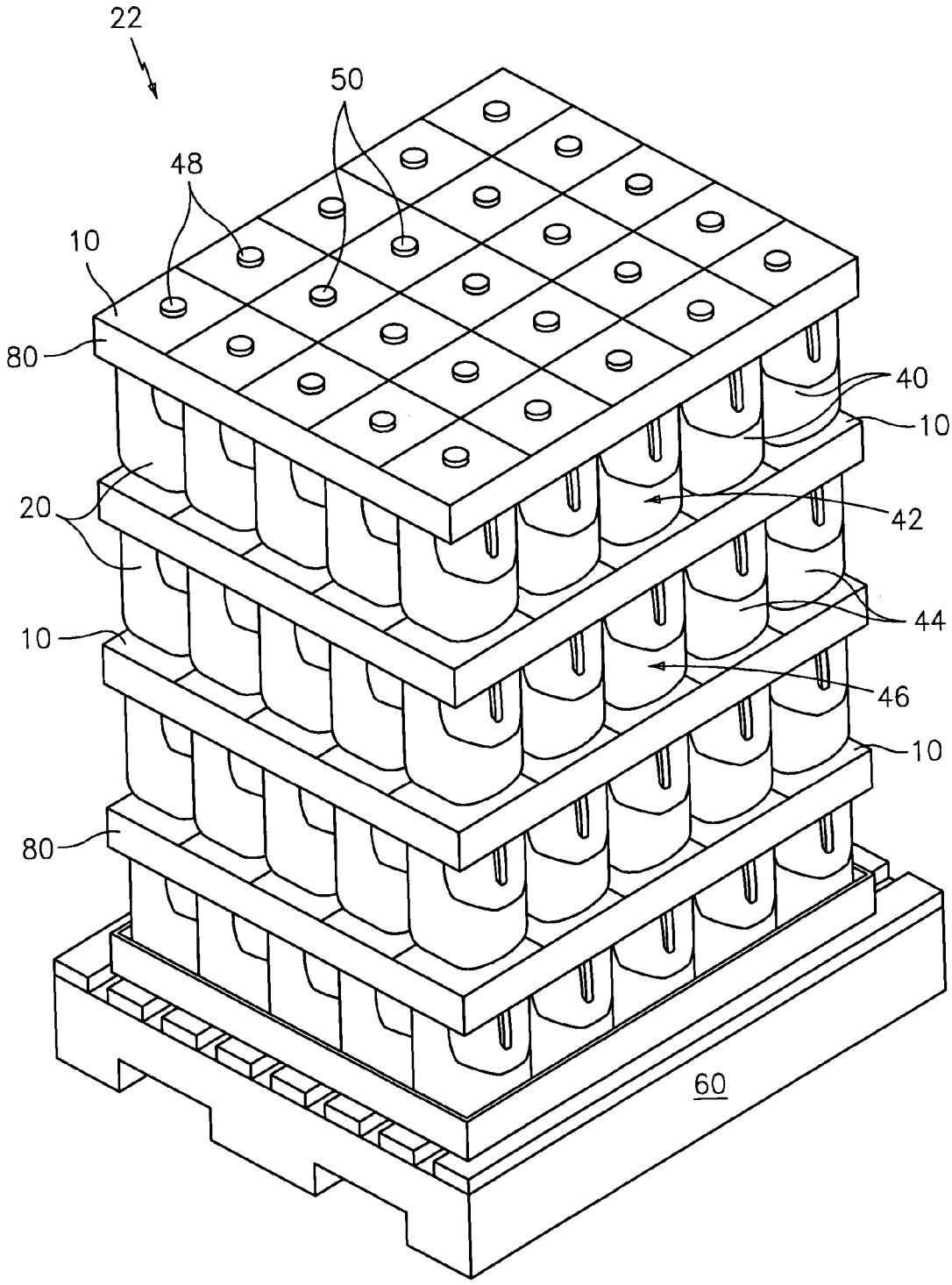
FIG. 4 is a perspective view of a stack of containers and separator elements positioned on a pallet.

Referring to the drawings, FIG. 1 shows a top view of a representative separator element 10 for placement with a stack of containers. The separator element 10 includes a plurality of openings 12, with outside openings 12*a* and inside openings 12*b*. The openings correspond to the spacing of the containers 20 in a stack of containers 22 as shown in FIGS. 2-4.

Figure 7:
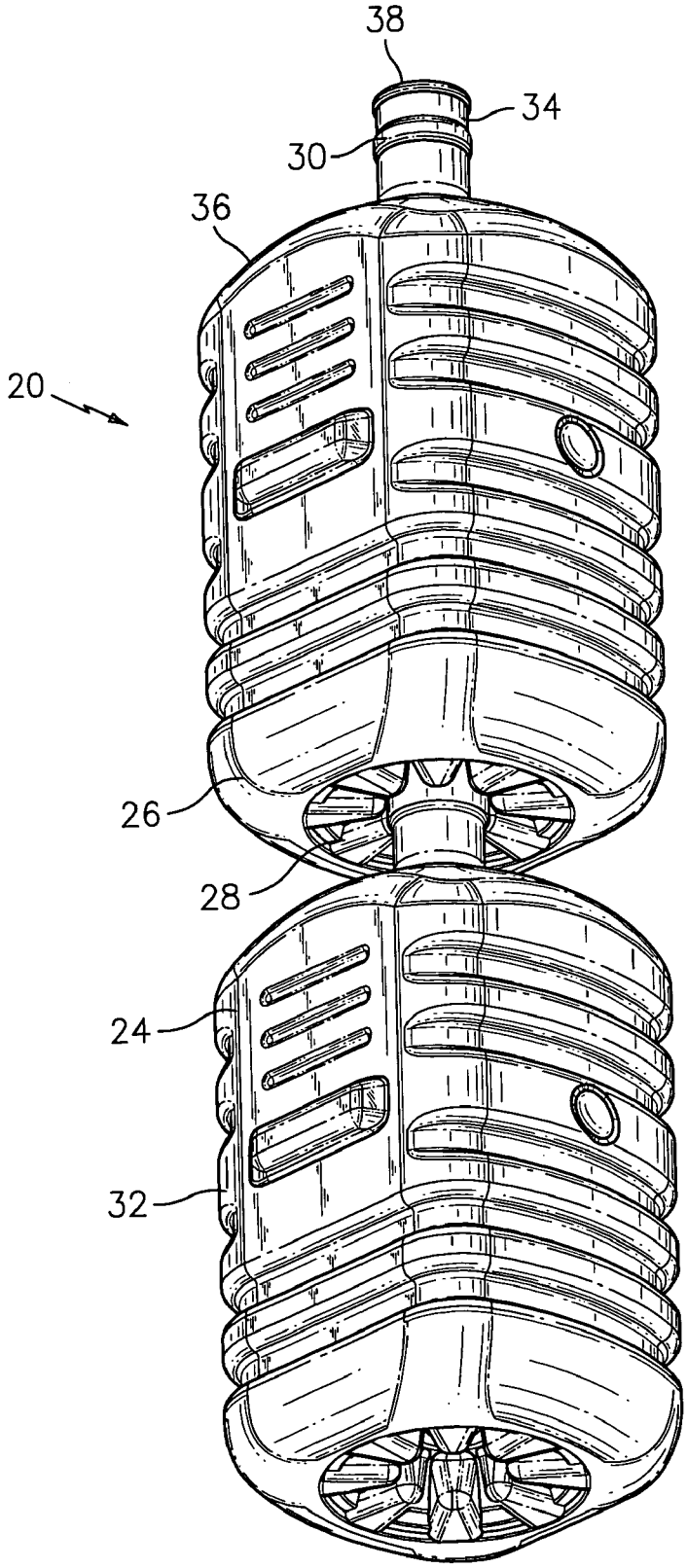
FIG. 7 shows a representative base to neck container nesting.

The container stack includes a plurality of containers 20 each having an outer surface 24, a base portion 26 with a depression 28 therein as clearly shown in FIG. 7. The containers also have an upper finish portion 30 opposed to base portion 26 and a sidewall 32 extending therebetween. Naturally, the particular container represented in FIG. 7 is illustrative only and a wide variety of shapes and sizes may be used. Preferably, the containers each have a capacity of one-half to 10 gallons and especially from 1-5 gallons. As shown in FIG. 7, the upper finish portion 30 includes an upwardly extending neck portion 34 which extends upwardly from shoulder portion 36. The neck portion 34 includes an opening 38 therein which is closable with a closure (not shown). Here again, the particular configuration of the neck and shoulder portions may vary and those shown in FIG. 7 are representative only. The upwardly extending neck portion 34 is preferably nestable with the depression 28 in the base portion 26 and a multi-layer stack of containers can readily be formed in this manner. Other stacking arrangements can-naturally be used, as for example, an upwardly extending shoulder portion of a first container can be nested with the base of a second container.

Thus, a stack of containers 22 is preferably provided with a plurality of first containers 40 in a first tier 42, and a plurality of second containers 44 nested with the first containers in a second tier 46, with each tier having outside containers 48 and inside containers 50. The particular container arrangement shown in the drawings is not critical and more or less containers can be provided in each tier. Also, the number of levels or tiers may of course by varied depending on requirements. For example, FIG. 3 shows three (3) levels or tiers and FIG. 4 shows four (4) levels or tiers. Also, the number of containers in each tier may vary from that shown. For example, instead of five rows of five containers in a row one may use four rows of four containers in a row, or three rows of three containers in a row, or even a single row with, for example, four or five containers in the row.

It is an objective of the present invention to minimize instability in the container stack, especially when transported on a pallet, such as pallet 60. For example, often a large amount of wrapping is used to secure the stack. However, this may be inconvenient and not fully effective.

In accordance with the present invention, one or more separator element 10 is placed on an arrangement of containers 20. Separator element 10 includes a plurality of openings 12, including outside openings 12*a* and inside openings 12*b*, with the spacing of the openings corresponding to the spacing of the containers 20 in the tier or level. The outer surface 24 of each container 20 is received in an opening as clearly shown, for example, in FIG. 3. The outside openings 12*a* engage the outer surface 24 of the outside containers 48 at an outer contact point 70 to secure the containers 20 in position, while the inside containers 50 are generally centered in the inside openings 12*b* as clearly shown in FIGS. 2 and 3. Thus, the engagement of the outside containers with the outside openings serves to press the containers together and secure the containers in each level. A separator element 10 would preferably be positioned in each level to secure each level in place. The inward pressure by the contact between the outside openings 12*a* and outside containers 48 serves to secure the containers in place. Movement and container placement may cause some inside containers to contact inside openings, but the container level will be more secure than without the separator element.

The separator element is preferably a cardboard or corrugated material, but naturally any desired material may be used, such as rigid plastic, fiberglass, wood, etc.

In the embodiment shown the container neck portion 34 is seated within the openings 12. However, a separator element may be used wherein the openings engage virtually any location on the outer surface of the containers depending upon need, for example, the openings may engage the shoulder portion or body portion if desired.

As can be seen in FIGS. 1 and 2, the spacing of the openings 12 is such that the outside openings 12*a* are positioned closer to the inside openings 12*b* than the inside openings are positioned with respect to each other. In the preferred embodiment a plurality of outside and inside openings are provided as shown; however, one can vary this configuration to interconnect at least some of the outside and/or inside openings. For example, one can interconnect the outside openings and even omit the inside openings.

The separator element 10 may be a sheet of material as shown in FIG. 3 which occupies a small portion of the upwardly extending length of the container, e.g., less than 10 per cent. Alternatively, at least some of the separator elements may have an outer, downwardly and/or upwardly extending edge flange 80 extending generally perpendicular to the separator element, as clearly shown in FIGS. 4 and 6, which aids in securing the assembly and may be suitable for product identification, logos, product information or the like. Preferably the separator element includes an outer flange portion which generally occupies less than 75% of the upwardly extending length of the container. In addition, the square shape shown in the drawings for the separator element and assembly is not critical and the separator element and assembly can take any desired or convenient shape, as, for example, round or rectangular.

Figure 5:
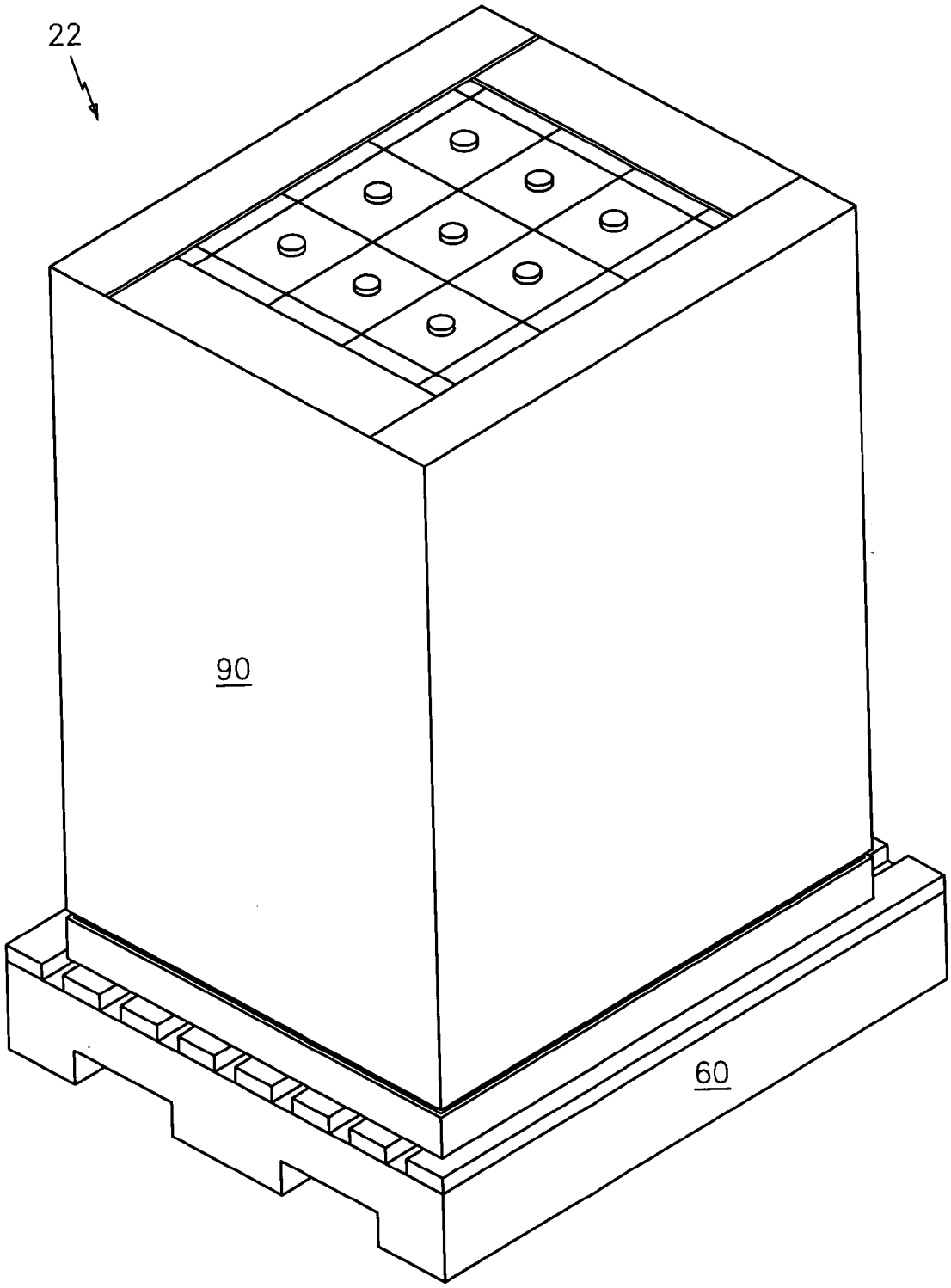
FIG. 5 is a perspective view of a stack of containers and separator elements with an outer wrapping and positioned on a pallet.
Figure 6:
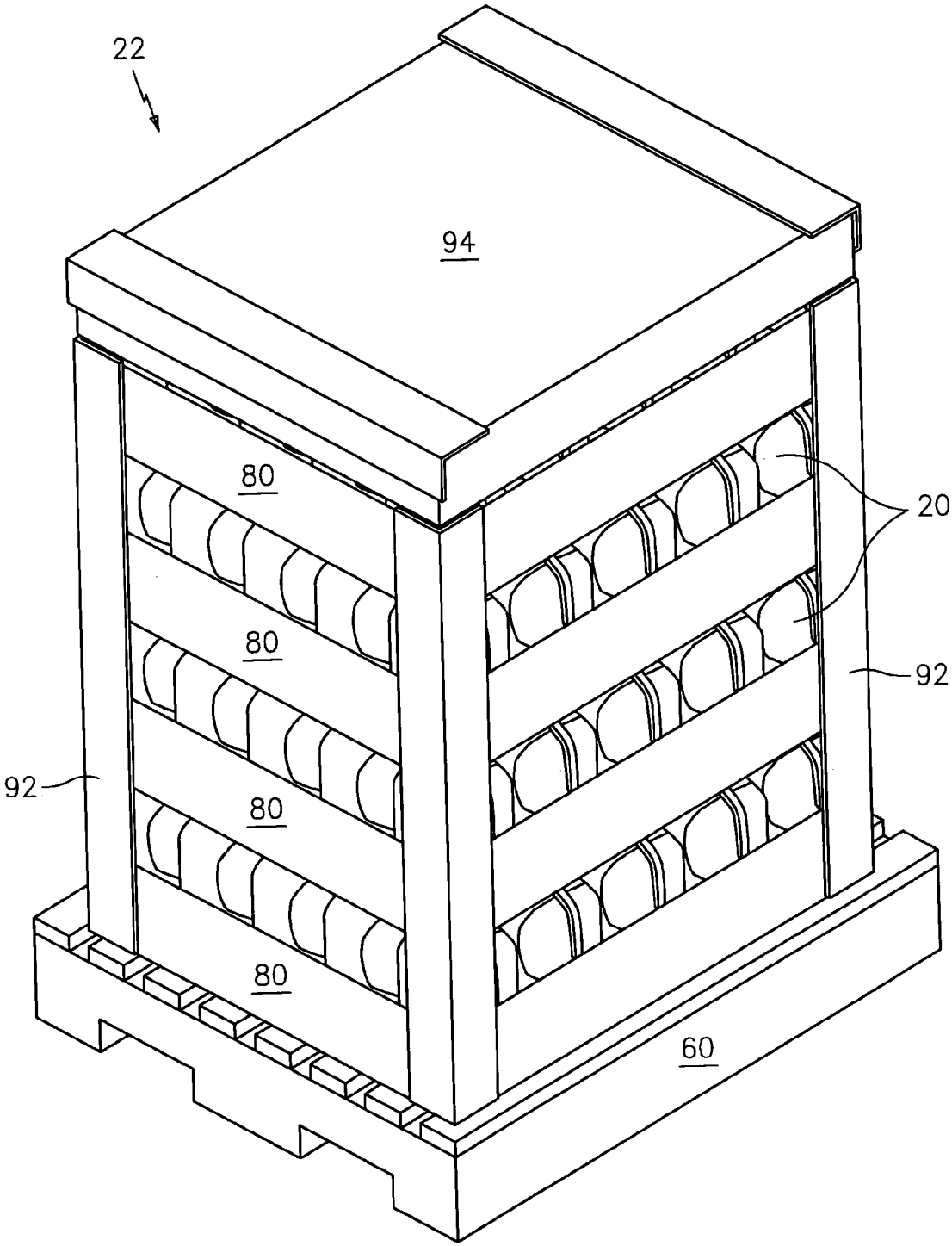
FIG. 6 is a perspective view of a stack of containers and separator elements with corner and upper wrapping and positioned on a pallet.

As shown in FIGS. 5 and 6, the container stack 22 may include outer wrapping 90 as for logo and/or identification, or corner posts 92 and upper cover portion 94 to provide for a self contained assembly, firmly secured by the separator elements. In addition, an outer plastic wrapping 96 and separate side supports 98 may be used as shown in FIG. 3. The side supports may if desired include logos and/or identification for direct merchandising.

In accordance with the present invention, a plurality of smaller separators may be used in one tier rather than a single, continuous separator.

The assembly including separator elements of the present invention as shown herein simply and conveniently provides a secure and firm assembly with ease of use.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plurality of stacked containers, which comprises:

a plurality of containers, each having an outer surface and a base portion, an upper finish portion opposed to said base portion, and a sidewall extending therebetween;

said finish portion including an opening therein which is closable with a closure, wherein the finish portion is nestable with the base portion of an additional container and the base portion is nestable with the finish portion of an additional container;

wherein a stack of said containers is provided by having a plurality of first containers in a first tier and a plurality of second containers nested with said first containers in a second tier, with each tier having outside containers and inside containers; and a separator element having outside open portions on opposed sides thereof, with the outside containers in the first tier each received in an outside open portion, wherein the outside open portions engage the outer surface of the outside containers to secure the containers in position;

wherein each separator element is a single, continuous element including a plurality of outside and inside openings; the openings corresponding to the spacing of said containers, with the containers in the first tier each received in an opening; and an outside opening is positioned closer to an inside opening than such inside opening is positioned with respect to an adjacent inside opening.

2. A plurality of stacked containers according to claim 1, wherein the base portion includes a depression therein, and the finish portion includes an upwardly extending neck portion, said upwardly extending neck portion being nestable with a depression in the base portion of an additional container, and the depression in the base portion being nestable with an upwardly extending neck portion of an additional container.

3. A plurality of containers according to claim 2, including a single, continuous separator element for each tier, wherein the upwardly extending neck portions of the containers in the first tier and second tier are each received in an opening, wherein the outside openings engage the neck portions of the outside containers to secure the containers in position.

4. A plurality of containers according to claim 3, including a plurality of outside openings and a plurality of inside openings, wherein the neck portion of each container is received in a separate opening.

5. A plurality of containers according to claim 3, wherein the inside containers pass into the center of an opening and the outside containers contact an edge of an opening to press the outside containers inwardly.

6. A plurality of containers according to claim 3, wherein the outside openings engage the neck portions of the outside containers to press the outside containers inwardly.

7. A plurality of containers according to claim 1, wherein said containers are plastic containers.

8. A plurality of containers according to claim 1, wherein the separator element is of corrugated material.

9. A plurality of containers according to claim 1, wherein the containers are 1 to 5 gallon containers.

10. A plurality of containers according to claim 1, wherein the engagement between the outside openings and the outside containers creates an inward force to secure the containers in position.

11. A plurality of containers according to claim 1, wherein each of the outside openings are positioned closer to the inside openings than the inside openings are positioned with respect to each other.

12. A plurality of stacked containers according to claim 1, wherein the separator element includes an outer flange portion running generally perpendicular to the area of the separator portion including openings.

13. A separator element for placement on a plurality of containers which are arranged together with outside containers and inside containers and with each container having an outer surface, which comprises:

a separator element having outside open portions on opposed sides thereof to receive the containers, wherein the outside containers are each received in an outside open portion, the outside open portions engage the outer surface of the outside containers to secure the containers in position; the separator is comprised of a single, continuous element having a plurality of outside and inside openings; the outer surface of each outside container is received in an opening; the outside and inside openings are spaced from each other with a spacing corresponding to the spacing of said containers; the openings receive the neck portions of said containers; the outside openings engage the neck portion of the outside containers; and an outside opening is positioned closer to an inside opening than the inside opening is positioned to an adjacent inside opening.

14. A separator element according to claim 13, wherein the outside openings engage the neck portions of the outside containers to press the outside containers inwardly.

15. A separator element according to claim 13, wherein said separator element is of corrugated material.

16. A separator element according to claim 13, wherein said openings are round and arranged in a square pattern.

17. A separator element according to claim 13, wherein each of the outside openings are positioned closer to the inside openings than the inside openings are positioned with respect to each other.

18. A separator element according to claim 13 wherein the separator element includes an outer flange portion running generally perpendicular to the area of the separator portion including openings.

19. A separator element according to claim 13, wherein at least a portion of the engagement between the outside openings and the outside containers creates an inward force to secure the containers in position.

* * * * *